US005425219A

United States Patent [19]

Tanaka et al.

[11] Patent Number: 5,425,219

[45] Date of Patent: Jun. 20, 1995

[54] METHOD AND APPARATUS FOR CUTTING AND RECOVERING BUNDLING BODY

[75] Inventors: Nobuhiro Tanaka; Eiji Hirata, both of Saitama, Japan

[73] Assignee: Kao Corporation, Tokyo, Japan

[21] Appl. No.: 110,852

[22] Filed: Aug. 24, 1993

[30] Foreign Application Priority Data

Sep. 3, 1992 [JP] Japan ..... 4-258880

[51] Int. Cl.[6] ..... B65B 69/00

[52] U.S. Cl. ..... 53/492; 53/381.2; 83/100; 83/909; 414/412

[58] Field of Search ..... 53/492, 381.2, 381.1; 414/412, 411; 83/100, 909

[56] References Cited

U.S. PATENT DOCUMENTS

| | | | |
|---|---|---|---|
| 3,750,504 | 8/1973 | Sidler | 83/100 X |
| 4,328,609 | 5/1982 | Born | 83/100 X |
| 4,681,507 | 7/1987 | Mojden et al. | 414/412 X |
| 4,718,157 | 1/1988 | Keyzers et al. | 83/100 X |
| 4,838,751 | 6/1989 | Paper | 414/412 |
| 4,997,329 | 3/1991 | Hanamoto et al. | 414/412 |
| 5,340,263 | 8/1994 | Neri et al. | 83/909 X |

FOREIGN PATENT DOCUMENTS

| | | |
|---|---|---|
| 0142846 | 5/1985 | European Pat. Off. . |
| 0249562 | 12/1987 | European Pat. Off. . |
| 2925256 | 1/1981 | Germany . |
| 3631 | 1/1991 | Japan . |
| 1097859 | 1/1968 | United Kingdom . |
| 7900682 | 9/1979 | WIPO . |

*Primary Examiner*—James F. Coan

*Attorney, Agent, or Firm*—Dvorak and Traub

[57] ABSTRACT

In a method of cutting and recovering a bundling body D or wrap for a bundle of articles, a bundling body sucking opening 42 is arranged in the vicinity of an article transferring position and so positioned as to maintain a constant distance to the side portion of an articles B in the condition where holding of the articles by the holding plates is released.

15 Claims, 6 Drawing Sheets

METHOD AND APPARATUS FOR CUTTING AND RECOVERING BUNDLING BODY

BACKGROUND OF THE INVENTION

1. Field of the Invention

The present invention relates generally to a method and an apparatus for cutting and recovering a bundling body or a wrap for a bundle of articles.

2. Description of the Related Art

In order to prevent an aggregate or stack of articles from falling apart, the outer circumference of the aggregate of the articles is bundled by means of a bundling body, such as a rope or strapping or so forth. A conventional apparatus for cutting and recovering such bundling body has been disclosed in Japanese Unexamined Patent Publication No. 3-631.

The conventional apparatus disclosed in the above-identified publication includes an article holding device including a holding tool for holding one layer of articles bundled by the bundling body, a bundle cutting device provided in the holding tool, an article transferring device for moving the article holding device from an article holding position to an article transferring position, and a bundling body recovering device having a bundling body sucking opening for recovering the cut bundling body.

However, in such conventional device, the bundling body sucking opening of the bundling body recovering device is arranged in the holding tool of the article holding device. The bundling body is cut while the holding tool of the article holding device holds the articles. In conjunction with releasing of the articles by the holding tool at the article transferring position, the already cut bundling body is drawn into the sucking opening of the recovering device for the bundling body for recovery.

However, the prior art encounters certain problems.

The bundling body sucking opening is provided on the holding tool of the article holding device. The bundling body is recovered by sucking and recovering through the sucking opening in conjunction with releasing of the articles by the holding tool. Therefore, upon sucking and recovering the bundling body by the sucking opening, the sucking opening can be placed away from the side portion of the article to lower the certainty of sucking and recovery of the bundling body.

The sucking opening has to have the height of the opening approximately equal to the overall height of the article so that the bundling body can be certainly sucked and recovered even when the bundling position of the bundling body around the article varies in vertical direction. This requires a greater sucking area. Therefore, the capacity of the drawing device must be large to make the bundling body recovering process effective.

SUMMARY OF THE INVENTION

It is an object of the present invention to positively suck and recover a bundling body after releasing the articles by a holding tool.

Another object of the invention is to positively suck and recover a bundling body with a down-sized bundling body recovering device.

According to one aspect of the invention, a method for cutting and recovering a bundling body comprises the steps of:

holding one layer of articles bundled by the bundling body, by means of a holding tool;

cutting the bundling body in the condition where the articles are held by the holding tool and transferring the articles to an article transferring position; and releasing the holding of the articles by the holding tool at the article transferring position and recovering the bundling body through a bundling body sucking opening;

wherein the improvement comprises:

arranging the bundling body sucking opening in the vicinity of the article transferring position so as to maintain a constant distance to the side portion of the articles in the condition where holding of the articles by the holding tool is released.

According to a second aspect of the invention, in combination with the first aspect of the invention, the bundling body sucking opening is arranged in opposition to the lower portion of the articles, in the vicinity of the article transferring position.

According to a third aspect of the invention, in combination with the first or second aspect of the invention, wherein in the article holding step, the articles are held by means of the holding tool not facing on a predetermined cutting portion of the bundling body, the articles are held by the holding tool facing on the predetermined cutting portion of the bundling body under the condition where holding by the holding tool not facing on the predetermined cutting portion is once released temporarily, and finally, the articles are held by the holding tool not facing on the predetermined cutting portion of the bundling body.

According to a fourth aspect of the invention, in combination with the first to third aspect of the invention, wherein by preliminarily selecting whether the articles to be held are bundled by the bundling body or not by a computer, the computer may preliminarily command to perform or not to perform cutting of the bundling body.

According to the fifth aspect of the invention, a device for cutting and recovering a bundling body comprises:

an article holding device holding one layer of articles bundled by the bundling body, by means of a holding tool;

a bundling body cutting device provided in the holding tool;

an article transferring device transferring the article holding device to an article transferring position from an article holding position; and a bundling body recovering device having a bundling body sucking opening for recovering the cut bundling body;

the improvement comprising:

the bundling body sucking opening of the bundling body recovering device being disposed in the vicinity of the article transferring position.

According to a sixth aspect of the invention, in combination with the fifth aspect of the invention, the bundling body sucking opening is disposed oppositely from the lower portion of the articles, in the vicinity of the article transferring position.

According to a seventh aspect of the invention, in combination with the fifth or sixth aspect of the invention, wherein a bundling body cutting position in the bundling body cutting device and a bundling body sucking position by the bundling body sucking opening are arranged in symmetric positions about a point on the stack of the articles.

According to a eighth aspect of the invention, in combination with the fifth to seventh aspect of the invention, wherein a cutting tool of the bundling body cutting device is designed to discharge a hot air via a flat and strip-formed duct toward the bundling body covering the stack of articles through a hot air blow-off slit arranged on the holding tool to cut the bundling body by melting.

According to a ninth aspect of the invention, in combination with the fifth to eighth aspect of the invention, wherein discharging of the hot air via the duct can be conducted and shut by opening and closing of a shut-off valve, the shut-off valve being controlled for adjusting the hot air discharging period depending upon a preliminarily registered thermal strength data or so forth of the bundling body.

According to the present invention, the following functions are performed.

The bundling body sucking opening is placed in the vicinity of the article transferring position. Even when the holding tool releases the articles, the sucking opening will never be positioned away from the side portion of the articles, so that an appropriate sucking position with a constant distance to the side of the articles can be maintained. Accordingly, when the holding tool releases holding of the articles at the article transferring position, the sucking opening can maintain an appropriate sucking force acting on the bundling body at the proper sucking position to positively suck the bundling body for recovery.

When the holding tool releases the articles at the article transferring position, the bundling body slips off along the side of the articles to positively pass across the position in front of the sucking opening which is positioned in opposition to the lower portion of the articles in the vicinity of the article transferring position, so that the bundling body can be sucked and recovered in the sucking opening. The sucking opening can positively suck and recover the bundling body only by locating at a local area opposing to the lower portion of the articles in the vicinity of the article transferring position. Therefore, it becomes unnecessary to expand the sucking area to the extent corresponding to the overall height of the article. Therefore, the capacity of the drawing device can be smaller to permit reduction of the size of the bundling body recovering device while maintaining certainty of sucking and recovering of the bundling body.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

Figure 1:
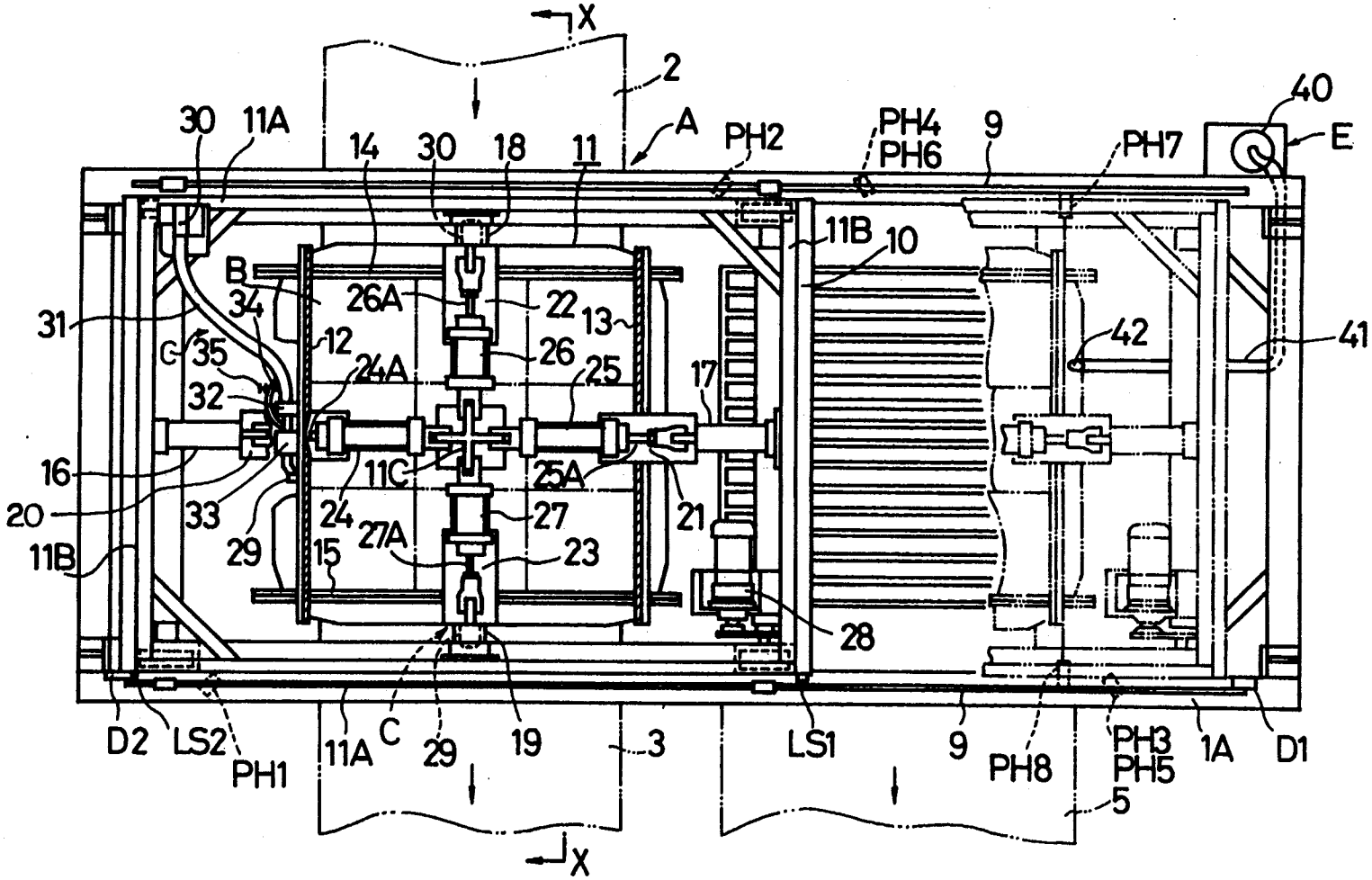
FIG. 1 is a plane view of one embodiment of the present invention.
Figure 2:
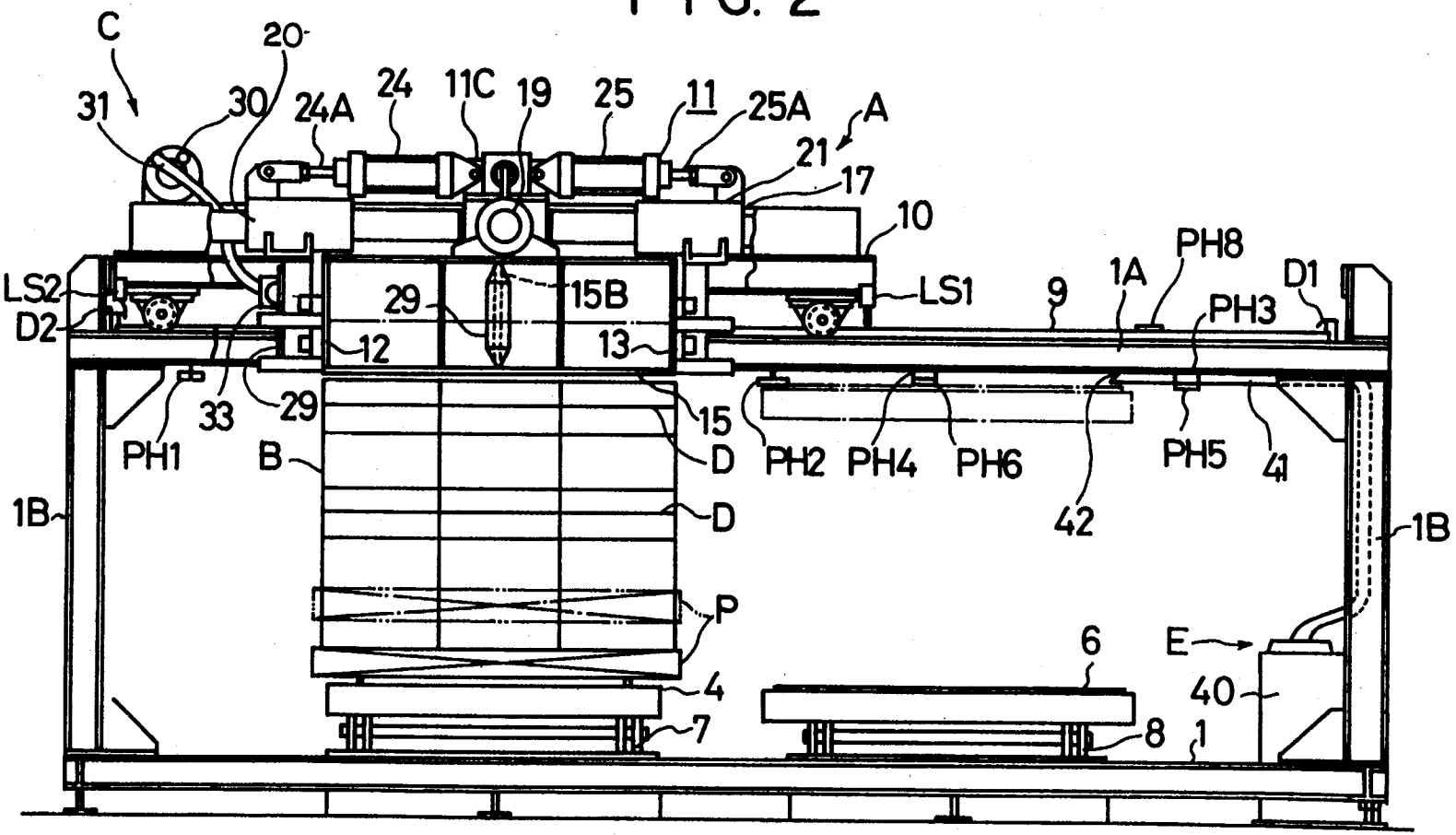
FIG. 2 is a front elevation of FIG. 1.

As shown in FIGS. 1 and 2, an article removal device A, to which the preferred embodiment of a cutting device for a bundling body is applied, is arranged in a rectangular framework 1 assembled on a floor. Within the framework 1, a first discharging conveyer 4 which receives a pallet P and articles B from a feed conveyer 2 for feeding pallets P mounted thereon, a plurality of articles B as a stack or aggregate of the articles, which articles are subject to depalletizing. The empty pallet P is transferred to a downstream side transporting conveyer 3, second discharges conveyer 6 discharging the depalletized articles B to a downstream side transporting conveyer 5. Elevating devices 7 and 8 are arranged below respective first and second transporting conveyers 4 and 6 for elevating the first and second transporting conveyers 4 and 6 up and down, as shown in FIG. 2.

On the other hand, on the upper surface of a frame member 1A positioned above the framework 1 via supports 1B, 1B, 1B, 1B, rails 9, are mounted. A carrier 10 is movably mounted on the rail 9. A holding device 11 is mounted on the carrier 10.

As shown in FIGS. 1 and 2, the holding device 11 includes two pairs of holding plates 12, 13 and 14, 15. Mutually opposing holding plates 12, 13 and 14, 15 are movable toward and away from each other about the center of the carrier 10, as a reference point, for holding and releasing a plurality of the articles B per layer. The holding device 11 comprises a pair of frame members 11A arranged on the carrier 10, a pair of frame members 11B perpendicularly intersecting with the frame members 11A, cross-like connecting body 11C arranged at the position of the reference point, guide cylinders 18, 19 and 16, 17 connected between the inner surfaces of the frame members 11A and 11B, and the connecting body 11C, sliding bosses 20, 21 and 22, 23 slidably fitted on the guide cylinders 16, 17 and 18, 19, cylinders 24, 25 and 26, 27 arranged at the upper sides of the sliding bosses 20, 21 and 22, 23, in which respective one ends of the cylinder 24, 25 and 26, 27 are connected to the connecting body 11C. Respective ends of rods 24A, 25A and 26A, 27A of the cylinders 24, 25 and 26, 27 are connected to the upper sides of respective sliding bosses 20, 21 and 22, 23 so that the sliding bosses 20, 21 and 22, 23 can be driven to slide by driving the cylinders 24, 25 and 26, 27.

On the other hand, the holding plates 12, 13 and 14, 15 are coupled on the lower side of the sliding bosses 20, 21 and 22, 23 so that the holding plates 12, 13 and 14, 15 can be driven toward and away from each other by driving the cylinder 24, 25 and 26, 27, as set forth above.

Figure 3A:
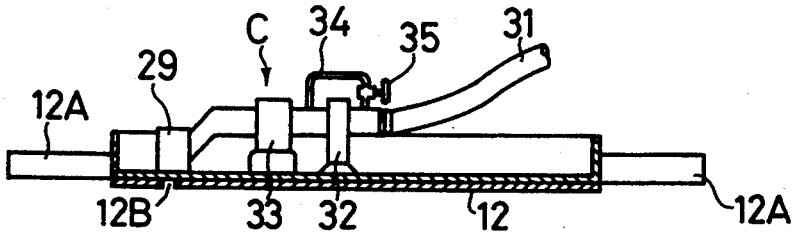
FIGS. 3A and 3B are diagrammatic illustrations showing a bundling body cutting device.
Figure 3B:
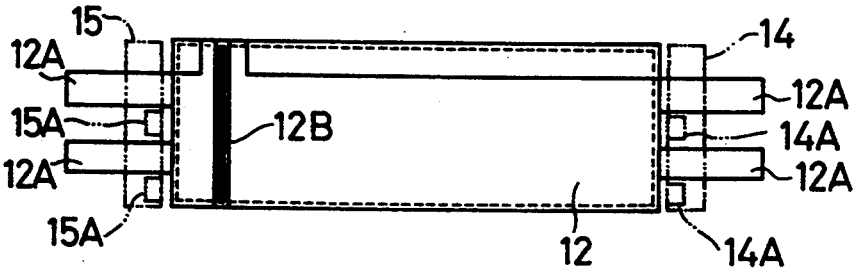

At both ends of the holding plates 14 and 15, respectively two channel members 14A and 15A are projected in spaced apart relationship, as shown in FIG. 3. On the other hand, respectively two channel members 12A and 13A are projected from the other pair of holding plates 12 and 13 at vertically offset positions relative to the channel members 14A and 15A so that the holding plates 14, 15 may not interfere with the holding plates 12, 13 for smoothly holding a plurality of articles B from four directions depending upon a layer unit consisting of a plurality of articles B.

On the lower surface of the frame member 1A, a pair of photo-switches PH1 and PH2 for detecting the upwardly elevated articles B by the elevating device 7, are arranged essentially above a pair of corner portions obliquely opposing the first discharging conveyer 4. When the articles B are elevated by the elevating device 7, they block the light beam between the photo-switches PH1 and PH2. After a predetermined period of time depending upon the height of one layer of the articles, the elevating device 7 is stopped. In conjunction with stopping of the elevating device 7, the cylinders 24, 25 and 26, 27 are driven for shifting the holding plates 12, 13 and 14, 15 toward each other for holding the articles B in the uppermost layer unit. Also, a pressure switch is provided in a piping connected to the cylinders 24, 25 and 26, 27 so that a plurality of articles B can be held with a predetermined holding force. When the pressure switch detects the predetermined pressure (holding force), the elevating device 7 is driven to lower the aggregate body of the other articles on the pallet P for a given distance to separate the held layer of the articles B from the aggregate body of the other articles on the pallet P. At the same time, a driving device 28 arranged on the carrier 10 is driven to run the carrier 10 toward the second discharge conveyer 6.

On the mating inner surfaces of the opposing frame members 1A, a pair of photo-switches PH7 and PH8 are arranged at an entrance level of the holding plate 13 at the leading end of the carrier 10 in the second discharge conveyer 6. The photo-switches PH7 and PH8 stop the driving device 28 to stop the carrier 10 when the light beam is blocked by the holding plate 13 of the holding device 11 entering into the second discharge conveyer side. The stop position of the holding device 11 is an article transferring position defined above the second discharge conveyer 6, which is located between the side portion of the articles B and a bundling body sucking opening 42 of a bundling body recovering device E. Therefore, the stop position of the carrier 10 above the second discharge conveyer 6 is determined at a position (article transferring position), in which the holding plate 13 of the holding device 11 certainly reaches the photo-switches PH7 and PH8 irrespective of the dimension of a layer unit. It should be appreciated that at the article transferring position, the carrier 10 is positioned substantially just above the second discharge conveyer 6.

An article take-out device A is designed to drive the elevating device 8 of the second discharge conveyer 6 for upwardly elevating the second discharge conveyer 6 while the carrier 10 travels.

On the other hand, on the lower surface of the frame member 1A, two pairs of photo-switches PH3, PH4 and PH5, PH6 are arranged so that light beams obliquely pass across above the second discharge conveyer 6. A pair of the photo-switches PH3 and PH4 are arranged at upper position relative to the other pair of the photo-switches PH5 and PH6. The upper photo-switches Ph3 and PH4 is responsive to blocking of their light beam by the second discharge conveyer 6 which is elevated upwardly, to stop the elevating device 8 at the position illustrated by two-dotted line in FIG. 2, namely the position where the second discharge conveyer 6 contacts the bottom of the articles B held by the holding device 11. At the same time, the photo-switches PH3 and PH4 drive the cylinders 24, 25 and 26, 27 of the holding device 11 to release the holding plates 12, 13 and 14, 15 from the articles B of the layer unit to transfer to the second discharge conveyer 6. Once the second discharge conveyer 6 receives the articles of the layer unit, the elevating device 8 lowers the second discharge elevator 6 to a level of a downstream side transporting conveyer 5. When the lowered position is reached, the second discharge conveyer 6 is driven to the articles B of the layer unit to transfer the articles to the transporting conveyer 5 for transporting the articles B to the next process by the transporting conveyer 5. On the other hand, when the second discharge conveyer 6 is lowered and reaches the position where the upper surface of the articles B reaches the lower side of the light beam of the photo-switches PH5 and PH6 to terminate blocking of the light beam between the photo-switches PH5 and PH6, the driving device 28 for the carrier 10 is driven to drive the holding device 11 toward the first discharge conveyer 4.

A limit switch LS2 is provided on the carrier 10 at the corner adjacent to the first discharge conveyer 4, i.e. on the downstream corner with respect to the flow direction of the articles B. Also, a dog D2 is arranged on the frame member 1A at the corner corresponding to the corner of the carrier 10. When the carrier 10 arriving from the side of the second discharge conveyer 6 reaches the position just above the first discharge conveyer 4, the limit switch LS2 detects the dog D2 to stop the driving device 28 to stop the carrier 10.

Hereinafter, discussion will be given for one embodiment of a bundling body cutting and recovering device according to the present invention and employed in the article removal device A constructed as set forth above.

The shown embodiment of a cutting device C for the bundling body includes a duct 29, and a hot air blow-off slit 12B. As shown in FIG. 3, as a cutting tool of the present invention, the hot air blow-off slit 12B at the tip end of the duct 29 formed into a flat and elongated configuration, is arranged on the holding plate 12. A cutting tool of the shown embodiment of the cutting device C is designed to discharge hot air via the flat and strip-formed duct 29 toward the bundling body D covering the stack of articles through the hot air blow-off slit 12B arranged on the holding plate 12 to cut the bundling body D by melting. As shown in FIG. 3, the duct 29 is arranged vertically with the flat surface perpendicular to the holding plate 12 so that the tip end thereof is opposed to the hot air blow-off slit 12B which extends vertically in the holding plate 12. The hot air discharged from the tip end of the duct 29 passes the hot air blow-off slit 12B into contact with the bundling body D extending in the horizontal direction for bundling the articles B to cut the bundling body D by melting. It should be noted that since the tip end of the duct 29 is formed in the vertically elongated configuration, the bundling body D can be positively cut irrespective of fluctuation of the bundling position thereof. Also, a clearance is provided at 3*d* between the tip end of the duct 29 and the outer surface of the holding plate 12. Also, the width M of the tip end of the duct 29 is smaller than the width L of the hot air blow-off slit 12B.

It should be appreciated that the cutting device C comprises a blower 30, a hose 31, a shut-off valve 32, a heater 33, a bypass hose 34 and a throttle valve 35 on the carrier 10 as shown in FIGS. 1 to 3. The air fed from the blower 30 is discharged toward the bundling body D from the hot air blow-off slit 12B via the shut-off valve 32, the heater 33 and the duct 29. Discharging of the hot air can be conducted and shut by opening and closing of the shut-off valve 32. The shut-off valve 32 may be controlled for adjusting the hot air discharging period depending upon a preliminarily registered thermal strength data or so forth of the bundling body D. For instance, in case of the bundling body D that is sensitive to heat, the hot air discharge period is set to be short (e.g. 0.5 sec.) and when the bundling body D has relatively high thermal strength or is wound in a plurality of wraps, the discharge period is set to be longer (e.g. 2 sec.) On the other hand, when air supply for the heating is completely stopped, the heater 33 may overheat. Therefore, in order to avoid this, a small amount of air is fed by bypassing the upstream and downstream of the shut-off valve 32 by the bypass hose 34 having the throttle valve 35 to permit a small amount of air constantly flowing for cooling the heater 33.

On the other hand, in application of the cutting device C for the bundling body, the bundling body D is preferably formed of a hot melt resin, such as polypropylene, polyethylene. In such case, the discharged centigrade temperature of the air is preferred in a range of 140°~260°, and more preferably in a range of 170°~230°. On the other hand, the distance S defined between the tip end of the duct 29 and the bundling body D is preferably in a range of 15~70 mm, and more preferably in a range of 25~50 mm. On the other hand, the width L of the hot air blow-off slit 12B is preferably in a range of 10~100 mm, and more preferably in a range of 20~50 mm. Also, the width M of the duct 29 is preferably in a range of 0.5~50 mm, and more preferably in a range of 1.5~2 mm. Furthermore, a hot air discharge amount is preferably in a range of 0.6 $m^2$/min~1.2 $m^2$/min, and more preferably in a range of 0.8 $m^2$/min~1.0 $m^2$/min.

The cutting device C for the bundling body is actuated when the articles B are fed with the pallet P from the feeding conveyer 2 to the first discharge conveyer 4 to initiate discharging of the hot air through the hot air blow-off slit 12B of the holding plate 12. Discharge of the hot air for the above-mentioned hot air continues during the discharging period for cutting the resin bundling body by melting with the hot air while the articles B at the upper end position are held by the holding plates 12, 13 and 14, 15 and are transferred to the second discharge conveyer 6 and are released to the second discharge conveyer 6.

The shown embodiment of a recovering device E for the bundling body is arranged around the article transferring position determined by detecting the holding plate 13 of the holding device 11 above the second discharge conveyer 6 by the photo-switch PH7 and PH8. The recovering device E has a drawing device 40 and a hose 41. A sucking opening 42 of the hose 41 arranged in the vicinity of framework 1 is arranged in the vicinity of the stop position of the holding plate 13 opposing the holding plate 12, in which the hot air blow-off slit 12B is formed. At the article transferring position the bundling body D melted by the hot air of the cutting device C is sucked and recovered through the sucking opening 42.

In the recovering device E, the sucking opening 42 is arranged in the vicinity of the article transferring position so that the distance between the sucking opening 42 and the side portion of the articles B under the condition where the holding plates 13 release the articles B from the articles holding positions, can be maintained constant.

Figure 4A:
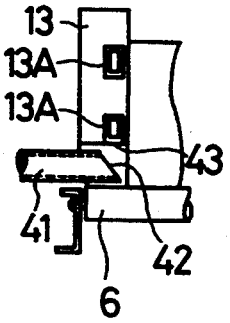
FIGS. 4A and 4B are diagrammatic illustrations showing a bundling body recovering device.
Figure 4B:
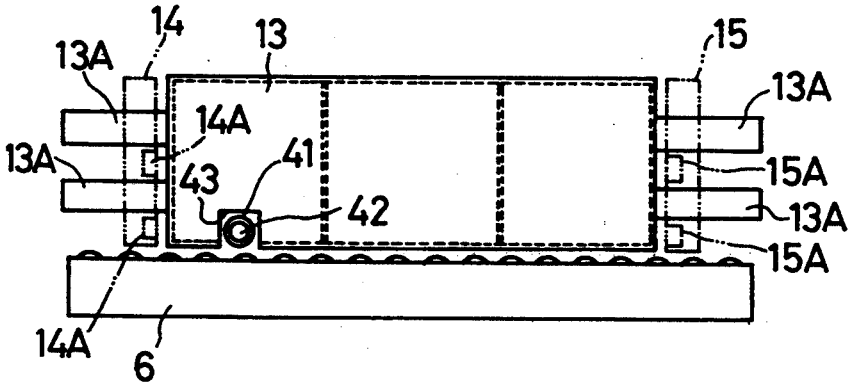
Figure 5A:
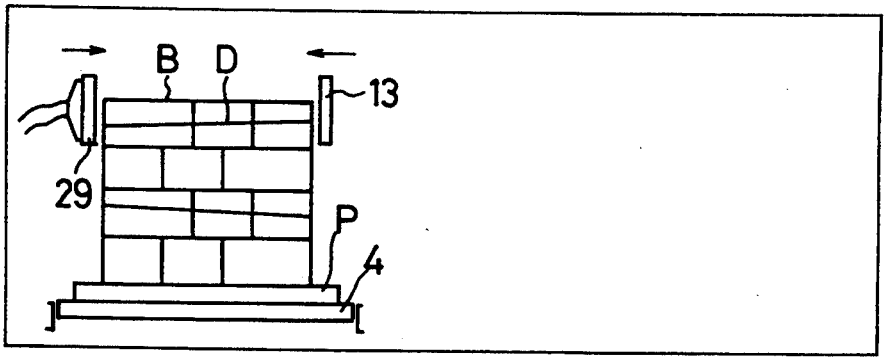
FIGS. 5A to 5D are diagrammatic illustrations showing a bundling body cutting and recovering operations.
Figure 5B:
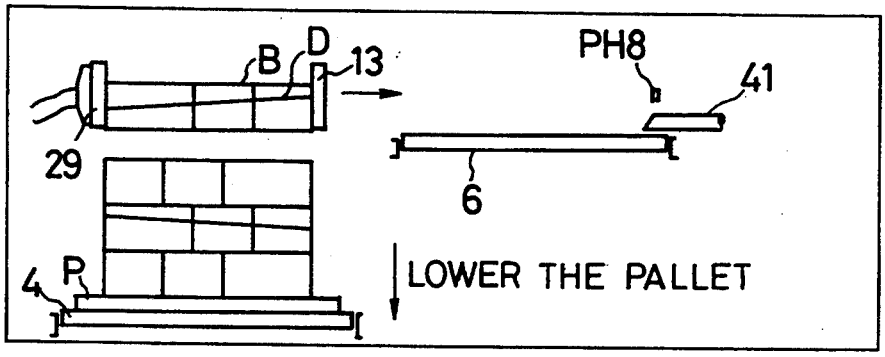
Figure 5C:
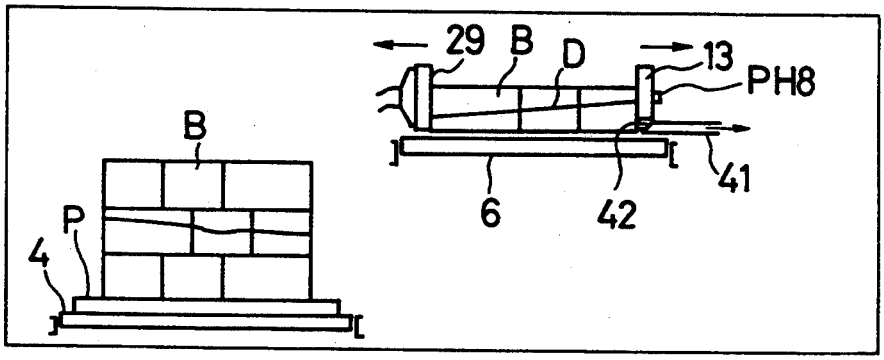
Figure 5D:
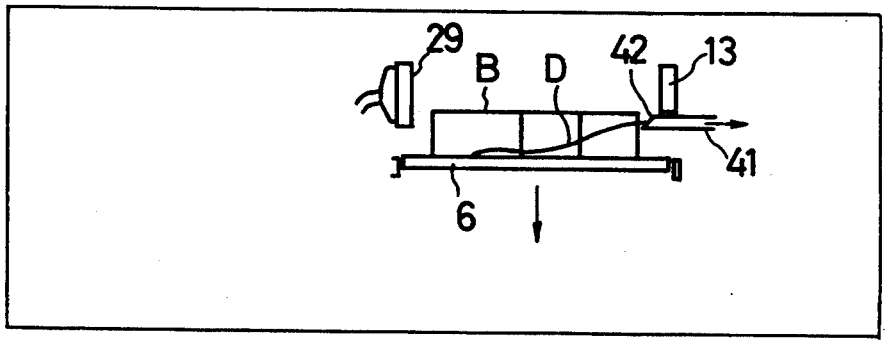

The sucking opening 42 is adapted to be arranged at a position opposing the lower portion of the article B at the side of the article transferring device. Therefore, a cut out 43 for the sucking opening 42 is formed on the lower edge of the holding plate 13 (see FIG. 4).

Accordingly, the cutting and recovering operations for the bundling body D by the cutting device C and the recovering device E are performed in the following manner (see FIG. 5).

(A) On the first discharge conveyer 4, the articles B in the uppermost layer are held by the holding plates 12, 13 and 14, 15 of the holding device 11, per layer.

(B) During traveling of carrier 10 from the first discharge conveyer 4 to the second discharge conveyer 6, the hot air is discharged through the duct 29 for cutting the bundling body D around the articles B.

(C) In terms of detection of the holding plate 13 by the photo-switches PH7 and Ph8, the carrier 10 is stopped at the article transferring position. At substantially the same time (at any time before releasing hold of the article B at the below-mentioned (D), and preferably slightly earlier for rising sucking force), sucking through the sucking opening 42 is initiated.

(D) In the above-mentioned article transferring position holding of the articles B by the holding plates 12~15 is released for transferring the articles B to the second discharge conveyer 6. Then, the second discharge conveyer 6 is lowered at an article transporting level. Here, the sucking opening 42 is maintained at an appropriate position with a constant distance to the side portion of the articles B even after release of the holding plate 13 so as to continue application of an appropriate sucking force for the bundling body. Thus, the bundling body D slips off along the side portion of the articles B in response to releasing of holding by the holding plate 13 and is lowered according to lowering motion of the second discharge conveyer 6 to positively pass in front of the sucking opening 42 to be sucked and recovered with an appropriate sucking force.

Figure 6A:
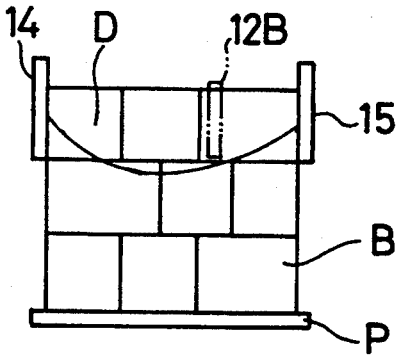
FIGS. 6A and 6B are diagrammatic illustrations showing a manner for holding articles.
Figure 6B:
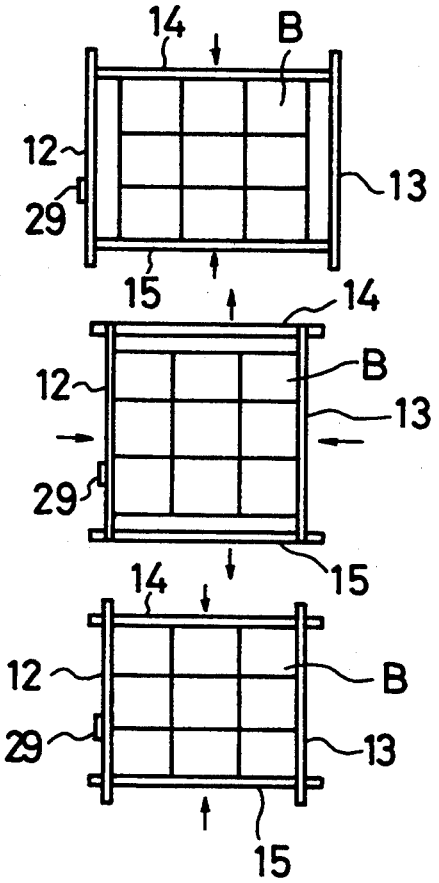

It should be appreciated that the holding operation by the holding device 11 and holding by the holding plate 12 which has the hot air blow-off slit 12B, is performed under the condition where the holding plates 14 and 15 are temporarily held at the released conditions. This is because when the stacked articles are held at one of XY directions, drooping of the bundling body D can be caused in the other side. When the drooping is caused in the bundling body D at the side facing the slit 12B, it is possible that the hot air cannot contact the bundling body D as shown in FIG. 6A. The foregoing procedure avoids this problem. Accordingly, as shown in FIG. 6B, at first, the articles B are held by the holding plates 14 and 15, the articles B are held by the holding plates 12 and 13 under the condition where holding by the holding plates 14 and 15 is released temporarily, and finally, the articles B are held again by the holding plates 14 and 15.

Figure 7:
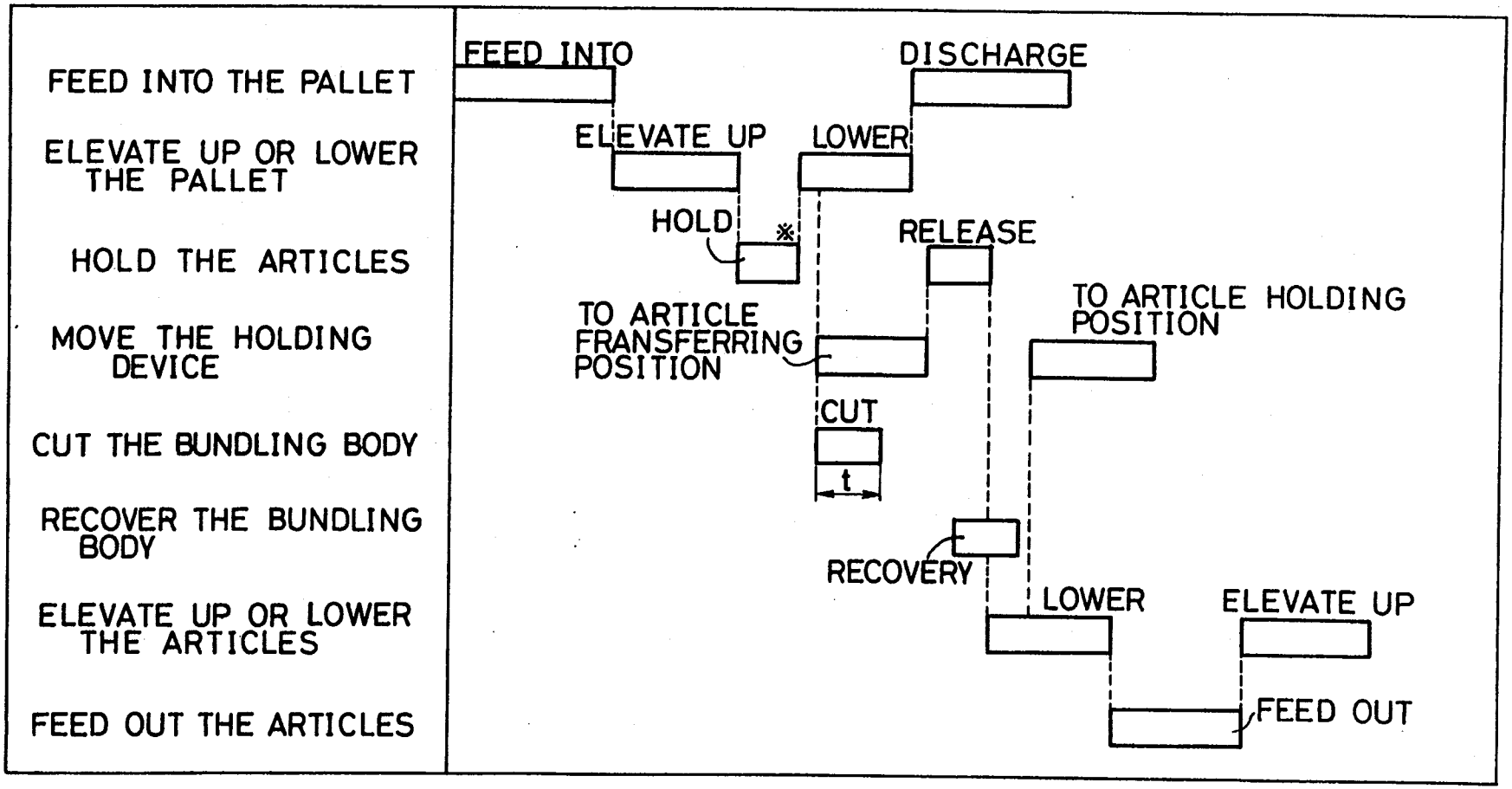
FIG. 7 is a flow diagram showing the bundling body cutting and recovering operations.

Next, discussion will be given for one embodiment of the bundling body cutting and recovering method according to the present invention in terms of an article removal apparatus, in which the preferred embodiment of the cutting device is employed (see FIG. 7).

The article removal device, in which the shown embodiment of the bundling body cutting device is employed, is suitably used in automatic storage equipment or so forth. A plurality of articles stored in the automatic storage are stacked on a pallet P in a multi-layer fashion and multi-stack fashion as the bundle of the articles. In order to prevent the bundle of the articles from falling apart, the bundle is wrapped with the bundling bodies D. The bundle of the articles on the pallet P is fed to the article removal device A by the feeding conveyer 2. As set out later, among two bundling bodies D, the upper side bundling body D is, at first, cut (cutting step) to take out the desired amount of articles B per layer. Then, the bundle of the remaining articles bundled by the intermediate side bundling body D is warehoused in the automatic storage system by means of the transporting conveyer 3. If the same article needs to be taken out, the bundle is again fed to the article removal device A by means of the feeding conveyer 2. Then, the intermediate side bundling body D is cut.

The bundle of the articles with the pallet P are fed into the first discharge conveyer 4 of the article removal device A by the feeding conveyer 2. Then, the elevating device 7 becomes active to elevate up the stack of the articles. After a given period following blocking of the light beam of the photo-switches PH1 and Ph2, namely while the elevating device 7 further elevates up the articles in a magnitude slightly greater than the height of the articles B in one layer and stops thereat, the cylinders 24, 25 and 26, 27 of the holding device 11 are driven to shift the holding plates 12, 13 and 14, 15 toward each other for holding the uppermost layer of articles B per layer unit. At this time, when the pressure switch detects the predetermined holding force, the elevating device 7 is driven to lower the articles in the lower layers for separating the held articles and the remaining articles in a given magnitude, e.g. approximately 50 mm. Thereafter, the driving device 28 of the carrier 10 is driven to drive the carrier 10 toward the second discharge conveyer 6.

When the photo-switches PH7 and PH8 detect the holding plate 13, and transferring of the aggregate of the articles to the article transferring position is completed, the carrier 10 stops. In conjunction with traveling of the carrier 10, the elevating device 8 is driven to lift the second discharge conveyer 6 to a position approximately 50 mm below from the bottom of the article B placed thereabove. During this upward travel, when the upper surface of the second discharge conveyer 6 blocks the light beam between the photo-switches PH5 and PH6, the elevating device 8 is temporarily stopped and placed at stand-by (condition shown by the two-dotted line in FIG. 2). When the carrier 10 stops, the elevating device 8 is again driven. When the upper surface of the second discharge conveyer 6 blocks the light beam between the photo-switches PH3 and PH4 (when the second discharge conveyer 6 is elevated up to the position where it substantially contacts the bottom of the articles B placed thereabove), the elevating device 8 is stopped. In conjunction with stopping of the elevating device 8, cylinders 24, 25 and 26, 27 of the holding device 11 are actuated to release the holding plates 12, 13 and 14, 15 for releasing articles to transfer the articles B to the second discharge conveyer 6.

On the other hand, when the aggregate of articles mounted on the pallet P and bundled by the bundling body D on the side surface thereof, is fed into the first discharge conveyer 4, the bundling body cutting device C initiates a discharging of the hot air from the tip end of the duct 29 to the bundling body D through the hot air blow-off slit 15B of the holding plate 15 while it travels from the first discharge conveyer 4 to the second discharge conveyer 6 and the articles B are released to be transferred onto the second discharge conveyer 6. Thus, the bundling body D is cut by melting with the hot air.

While the bundling body D thus cut, the bundling body recovering device E initiates sucking of the bundling body D around the aggregate of the articles arriving at the article transferring position by detecting the holding plate 13 by means of the photo-switches PH7 and PH8. At the same time, the holding device 11 releases the articles B on the second discharging conveyer 6. Thus, the bundling body D which is cut and placed in free condition is sucked and recovered through the sucking opening 42.

When the bundling body D is thus removed and the articles B are transferred to the second discharge conveyer 6, the elevating device 8 is driven to lower the second discharge conveyer 6 to the level correspond to the transporting conveyer 5. Then, by driving the second discharge conveyer 6, the articles B are transferred to the transporting conveyer 5 to complete feeding out of the articles. Once feeding out the articles from the second discharge conveyer 6 to the transporting conveyer 5 is completed, the second discharge conveyer 6 is elevated by the elevating device 8 to a stand-by position (position shown by two-dotted line in FIG. 2) for receiving the next articles. When the upper surface of the second discharge conveyer 6 blocks the light beams of the photo-switches PH5 and PH6, the second discharge conveyer 6 stops upward movement. The carrier 10 travels toward the first discharge conveyer 4 when the holding device 11 releases the articles B and the articles B are lowered in a position to avoid interference with the holding plates 12, 13 and 14, 15, namely where the upper surface of the articles B during downward motion of the second discharge conveyer 6 reaches the position below the light beam of the photo-switches PH5 and PH6. When the limit switch LS2 detects the dog D2, the carrier 10 stops. Subsequently, a similar manner of operations are repeated. If the necessary number of layers of articles are taken out, the aggregate of the articles left on the first discharge conveyer 4 is discharged to the transporting conveyer 3 to be warehoused in the automatic storage and fed again to the article removing device A when necessary.

The effect of the present invention will be discussed hereinafter.

The bundling body sucking opening 42 is placed in the vicinity of the article transferring position. Even when the holding device 11 releases holding of the articles B, the sucking opening 42 will never be positioned away from the side portion of the articles so that an appropriate sucking position with a constant distance to the side of the articles can be always maintained. Accordingly, when the holding device 11 releases holding of the articles B at the article transferring position, the sucking opening 42 can maintain an appropriate sucking force acting on the bundling body D at the proper sucking position to positively recover the bundling body D.

When the holding device 11 releases the articles B at the article transferring position, the bundling body D slips off along the side of the articles to positively pass across the position in front of the sucking opening 42 which is positioned in opposition to the lower portion of the articles in the vicinity of the article transferring position, so that the bundling body can be sucked and recovered to the sucking opening 42. The sucking opening 42 can certainly suck and recover the bundling body D only by locating at a local area opposing to the lower portion of the articles in the vicinity of the article transferring position. Therefore, it becomes unnecessary to expand the sucking area to cover the overall height of the article B. Therefore, the capacity of the drawing device 40 can be made small to permit reduction of the size of the bundling body recovering device E while maintaining certainty of sucking and recovering of the bundling body D.

It should be noted that the bundling body cutting and recovering method and apparatus according to the present invention should not be limited to the foregoing embodiment. For instance, it is possible to constantly discharge the hot air to the hot air blow-off slit 12B, or to discharge after holding the articles. Also, various cutting tools, such as knife type, hot plate type and so forth can be equally employed. Furthermore, the first discharge conveyer 4 and the second discharge conveyer 6 may be lifted up and down by means of chains employed for transmitting driving torques of motors.

Also, by preliminarily selecting whether the articles B to be held are bundled by the bundling body D or by a computer, the computer may preliminarily command a control unit of the article take-out device A for performing or not performing cutting of the bundling body D.

On the other hand, the bundling cutting method according to the present invention does not always require that the tip end of the duct 29 be arranged in the holding device 11.

Furthermore, the bundling body cutting device according to the present invention does not always require to provide the cutting tool of the cutting device C on the holding plate 12, 13, 14 or 15.

Also, the holding device according to the present invention may hold the aggregated articles at opposing two sides (for example, by the holding plates 12 and 13), instead of holding at four sides.

Furthermore, the bundling recovering device according to the present invention may constantly and continuously exert sucking force.

In addition, in implementation of the present invention, it is preferred that the bundling body cutting position in the bundling body cutting device and the bundling body sucking position by the bundling body sucking opening are arranged in symmetric positions about a point on the stack of the articles. By this, the length of the cut pieces of the bundling body at both sides become substantially equal to each other to reduce resistance in sucking.

As set forth, according to the present invention, the bundling body can be positively sucked and recovered after releasing of the holding of the articles by the holding tool.

According to the present invention, the bundling body can be positively sucked and recovered with a reduced size of the bundling body recovering device.

What is claimed is:

1. A method for cutting and recovering a bundling body or wrap for a bundle of articles comprising the steps of:

holding one layer of articles held by the bundling body with a holding tool;

cutting the bundling body where the articles are held by the holding tool and transferring the articles to an article transferring position; and releasing the hold of the articles by the holding tool at the article transferring position and recovering the bundling body through a bundling body sucking opening;

wherein the improvement comprises:

arranging the bundling body sucking opening in the vicinity of the article transferring position in opposition to a lower portion of the articles, so as to maintain a constant distance to the side portion of the articles when holding of the articles by the holding tool is released, and recovering the bundling body with the bundling body sucking opening while the articles transferred to the article transferring position are being lowered.

2. A method as claimed in claim 1, wherein in the article holding step, the articles in a first step are held by means of the holding tool positioned to not face a predetermined cutting portion of the bundling body, the articles in a second step are next held by the holding tool facing the predetermined cutting portion of the bundling body during a period of time when the hold of the holding tool positioned to not face the predetermined cutting position is released temporarily, and in a final step the articles are again held by the holding tool positioned to not face the predetermined cutting portion of the bundling body.

3. A method as claimed in claim 1 wherein in the articles in the first step are first held by means of the holding tool positioned to not face a predetermined cutting portion of the bundling body, the articles in a second step are next held by the holding tool facing the predetermined cutting portion of the bundling body during a period of time when the hold of the holding tool positioned to not face the predetermined cutting portion is released temporarily, and in a final step the articles are again held by the holding tool positioned to not face the predetermined cutting portion of the bundling body.

4. A method as claimed claim 1 where a computer selection is made whether the articles to be held are bundled or not bundled by the bundling body and a computer selection is made to perform or not to perform cutting of the bundling body.

5. A method as claimed in claim 1, wherein a computer selection is made whether the articles to be held are bundled or not bundled by the bundling body and a computer selection is made to perform or not to perform cutting of the bundling body.

6. A method as claimed in claim 3, wherein a computer selection is made whether the articles to be held are bundled or not bundled by the bundling body and a computer selection is made to perform or not to perform cutting of the bundling body.

7. A device for cutting and recovering a bundling body or wrap for a bundle of articles comprising:

an article holding device holding one layer of articles bundled by the bundling body with a holding tool;

a bundling body cutting device provided in the holding tool;

an article transferring device adapted to transfer the article holding device to an article transferring position from an article holding position; and a bundling body recovering device having a bundling body sucking opening for recovering the cut bundling body;

the improvement comprising:

the sucking opening of the bundling body recovering device being located at a position in opposition to a lower portion of the articles, in the vicinity of the article transferring position, and an elevating device for elevating the articles transferred to the article transferring position.

8. A device as claimed in claim 7 wherein a cutting tool of the bundling body cutting device is designed to discharge hot air, via a flat strip-shaped duct, toward the bundling body covering the stack of articles, the hot air traveling through a hot air blow-off slit arranged on the holding tool to cut the bundling body by melting.

9. A device as claimed in claim 7 wherein discharging of the hot air via the duct is allowed and disallowed by opening and closing a shut-off valve, the shut-off valve being controlled for adjusting the hot air discharging period depending upon predetermined thermal strength data relating to the bundling body.

10. A device as claimed in claim 7, wherein a bundling body cutting position in the bundling body cutting device and a bundling body sucking position by the bundling body sucking opening are arranged in symmetric positions about a point on the stack of the articles.

11. A device as claimed in claim 7, wherein discharging of the hot air via the duct is allowed and disallowed by opening and closing a shut-off valve, the shut-off valve being controlled for adjusting the hot air discharging period depending upon predetermined thermal strength relating to the bundling body.

12. A device as claimed in claim 8, wherein discharging of the hot air via the duct is allowed and disallowed by opening and closing a shut-off valve, the shut-off valve being controlled for adjusting the hot air discharging period depending upon predetermined thermal strength data relating to the bundling body.

13. A device as claimed in claim 10, wherein discharging of the hot air via the duct is allowed and disallowed by opening and closing a shut-off valve, the shut-off valve being controlled for adjusting the hot air discharging period depending upon predetermined thermal strength date relating to the bundling body.

14. A device as claimed in claim 7, wherein a cutting tool of the bundling body cutting device is designed to discharge hot air, via a flat strip-shaped duct, toward the bundling body covering the stack of articles, the hot air traveling through a hot air blow-off slit arranged on the holding tool to cut the bundling body by melting.

15. A device as claimed in claim 10, wherein a cutting tool of the bundling body cutting device is designed to discharge hot air, via a flat strip-shaped duct, toward the bundling body covering the stack of articles, the hot air traveling through a hot air blow-off slit arranged on the holding tool to cut the bundling body by melting.

* * * * *